US007722473B1

(12) United States Patent
Shah

(10) Patent No.: US 7,722,473 B1
(45) **Date of Patent: *May 25, 2010**

(54) GOLF TRAINING AID

(76) Inventor: Sarmad A. Shah, 10602 Timberwood Cir., Suite 3, Louisville, KY (US) 40223

( * ) Notice: Subject to any disclaimer, the term of this patent is extended or adjusted under 35 U.S.C. 154(b) by 0 days.

This patent is subject to a terminal disclaimer.

(21) Appl. No.: 12/467,520

(22) Filed: May 18, 2009

Related U.S. Application Data

(63) Continuation-in-part of application No. 12/028,264, filed on Feb. 8, 2008, now Pat. No. 7,547,257.

(60) Provisional application No. 60/955,495, filed on Aug. 13, 2007.

(51) Int. Cl.
*A63B 69/36* (2006.01)

(52) U.S. Cl. ..... 473/218; 473/270; 473/277

(58) Field of Classification Search ..... 473/207, 473/217, 218, 266, 269, 270, 271, 273, 277
See application file for complete search history.

(56) References Cited

U.S. PATENT DOCUMENTS

| | | | | | |
|---|---|---|---|---|---|
| 2,847,769 | A | * | 8/1958 | Schlesinger | 36/127 |
| 3,195,891 | A | * | 7/1965 | Rogers | 473/217 |
| 3,218,734 | A | * | 11/1965 | O'Brien | 36/133 |
| 3,363,903 | A | * | 1/1968 | O'Brien | 473/273 |
| 3,866,339 | A | * | 2/1975 | Latto | 36/100 |
| 3,951,407 | A | * | 4/1976 | Calacurcio | 473/217 |
| 4,073,075 | A | * | 2/1978 | O'Brien | 36/127 |
| 4,081,918 | A | * | 4/1978 | O'Brien | 36/132 |
| 4,118,034 | A | * | 10/1978 | O'Brien | 473/217 |
| 4,145,055 | A | * | 3/1979 | O'Brien | 473/217 |
| 4,147,356 | A | * | 4/1979 | Brandell | 473/271 |
| 4,819,940 | A | * | 4/1989 | Davis | 473/217 |
| 4,866,861 | A | * | 9/1989 | Noone | 36/127 |
| 4,875,683 | A | * | 10/1989 | Wellman et al. | 473/217 |
| 4,979,760 | A | * | 12/1990 | Derrah | 280/607 |
| 5,197,739 | A | * | 3/1993 | Johnson, III | 473/271 |
| 5,212,894 | A | * | 5/1993 | Paparo | 36/43 |
| 5,263,863 | A | * | 11/1993 | Stefani et al. | 473/269 |
| 5,288,074 | A | * | 2/1994 | Scheurer | 473/277 |
| D352,756 | S | * | 11/1994 | Giantonio | D21/791 |
| 5,445,384 | A | * | 8/1995 | Yancey | 473/217 |
| 5,487,546 | A | * | 1/1996 | Yasuda | 473/217 |
| 5,762,565 | A | * | 6/1998 | Milam et al. | 473/271 |
| 5,916,037 | A | * | 6/1999 | Hill | 473/277 |
| 6,247,252 | B1 | * | 6/2001 | Parisotto | 36/118.7 |
| 6,708,425 | B2 | * | 3/2004 | Parisotto | 36/118.2 |
| 7,547,257 | B1 | * | 6/2009 | Shah | 473/218 |

* cited by examiner

*Primary Examiner*—Nini Legesse
(74) *Attorney, Agent, or Firm*—James E. Cole; Middleton Reutlinger

(57) ABSTRACT

A golf training device, comprising a wearable wedge shaped body for receiving a user's trailing foot and restricting lateral movement of a user's hip, at least one foot strap assembly connected to the wedge shaped body, a guide rod system connected to the wedge shaped body comprising, a base portion connected to the wedge shaped body, a collar disposed in the base portion, and, a guide rod engaging the collar and extending upwardly from the collar toward the user's hip, the guide rod system indicating a swing error when the user's hip contacts the guide rod.

20 Claims, 10 Drawing Sheets

GOLF TRAINING AID

CROSS REFERENCES TO RELATED APPLICATIONS

This application is a Continuation-in-Part of and claims priority to and benefit from, currently pending, U.S. Ser. No. 12/028,264, filed Feb. 8, 2008, which claims priority to and benefit under 35 U.S.C. §119(e) to U.S. Provisional Patent Application Ser. No. 60/955,495, filed on Aug. 13, 2007.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to golf training aid, and more specifically to a golf training aid to develop muscle memory and correct golf pivot action.

2. Description of the Related Art

It is widely recognized in the play of golf that in order to generate power and consistency a player must correctly pivot, which according to one teaching method requires correct "stacking" of the upper body against the lower body at the top of the golf swing, and unwinding of the torso against the lower body. Alternatively stated, a player must have a proper relationship between movement of the upper body and lower body which requires a clear understanding of the relationship between the torso and the legs. A good relationship between legs and torso provides a steady center of gravity as the torso winds and unwinds around the pivoting point resulting in power and consistency in the golf swing.

Better golfers create proper angles at address, top of the backswing and at the point of impact. If the body moves correctly, the player creates an increased amount of speed at impact, resulting in longer shots and better ball striking. One type of motion known to create additional speed and proper motion is known as stack-and-tilt golf swing. The stack-and-tilt swing golf swing involves creating proper position of the head, right knee, right leg and hip and feel of tension and pulling of the inner right thigh muscles (for right handed golfer) against the upper torso and weight transfer around the sternum (center of the chest) and tailbone during the take-away, back swing, downswing, at impact and follow-through.

Distinct from the stack-and-tilt motion, all golf swings benefit from limiting lateral movement of the head and spine. This limitation aids the return of the golf club from the top of the swing to the setup position more consistently, which results in more consistent contact with the golf ball.

It is preferable to provide a novel training aid to provide golfers with an apparatus to achieve improved pivot, footwork and relationship between the torso and the legs.

SUMMARY OF THE INVENTION

With regard to the foregoing, one embodiment of the invention eliminates the oversights, difficulties, and disadvantages of the prior art by providing a golf training aid which teaches correct positioning for a golf swing.

A golf training device comprises a wearable wedge shaped body for receiving a user's trailing foot and restricting lateral movement of a user's hip, at least one foot strap assembly connected to the wedge shaped body, a guide rod system connected to the wedge shaped body comprising, a base portion connected to the wedge shaped body, a collar disposed in the base portion, and, a guide rod engaging the collar and extending upwardly from the collar toward the user's hip, the guide rod system indicating a swing error when the user's hip contacts the guide rod. The golf training device wherein the wedge forces weight to the inside of the user's trailing foot. The golf training device further comprising a forward foot strap assembly connected to the body. The golf training device wherein the forward strap assembly is adjustable to tighten or loosen utilizing an adjustable quick disconnect. The golf training device wherein the forward strap assembly has a first strap and a second strap which are connected by an adjustable quick disconnect. The golf training device further comprising at least one rearward strap assembly connected to the body. The golf training device wherein the at least one rearward ankle strap has an outside portion, an inside portion and a strap assembly. The golf training device wherein the strap assembly comprises a first strap having a plurality of teeth and a second strap having a quick disconnect.

A wearable golf training device for a golf swing comprising a body having a wedge shape with a high side and a low side, and an inside of the body being the low side and an outside of the body being the high side, the body receiving a user's trailing foot and restricting lateral movement of the user's hip, a forward strap assembly connected to the body and a rearward ankle strap assembly including an ankle portion, and, a guide rod system comprising a base portion connected to the body, a collar disposed in the base portion, a guide rod being received by the pivotable collar extending upwardly from the collar toward or away from a user's hip, the guide rod system indicating excessive lateral movement during a golf swing when the user's hip contacts the guide rod. The golf training device further comprising a first strap assembly near a forward portion of the body, and a second ankle strap assembly near a rear portion of the body. The golf training device wherein the first strap assembly has a first strap and a second strap, one of the first and second straps having teeth, the other of the first and second straps having an adjustment mechanism for engaging the teeth. The golf training device wherein the ankle strap assembly has an inside stirrup portion along the inside of the body, an outside stirrup portion along the outside of the body and an ankle portion connects the outside stirrup portion and the inside stirrup portion. The golf training aid further comprising a first strap and a second strap, one of the first strap and the second strap having teeth and the other of said first and second strap having an adjustable quick connect mechanism, the first strap connected to the outside stirrup and the second strap connected to the inside stirrup. The golf training device wherein the body is a molded device. The golf training device wherein the body and the base portion are integrally molded. The golf training device wherein one of the body and the base portion has an insert, and the other of the base portion and the body has a cavity for receiving the insert. The golf training device further comprising cleats depending from the body. The golf training device wherein the cleats are molded to the body. The golf training device wherein the cleats are removable from the body.

A golf training aid comprising a body having a wedge shape wherein an outside of the body is higher than the inside of the body, the wedge shaped body inhibiting lateral movement of a user's body and promoting loading of an inside thigh muscle of the user, a guide rod system having a base which is one of integrally formed with or removably connected to the body, the guide rod system having a collar extending from the body, the collar engaging a guide rod, the guide rod extending upwardly from the base, a first strap assembly at a forward portion of the body and a second ankle strap assembly at a rear portion of the body, each of the first strap and said second strap being adjustable for tightening and loosening the training aid on a user's foot.

DETAILED DESCRIPTION

Figure 1:
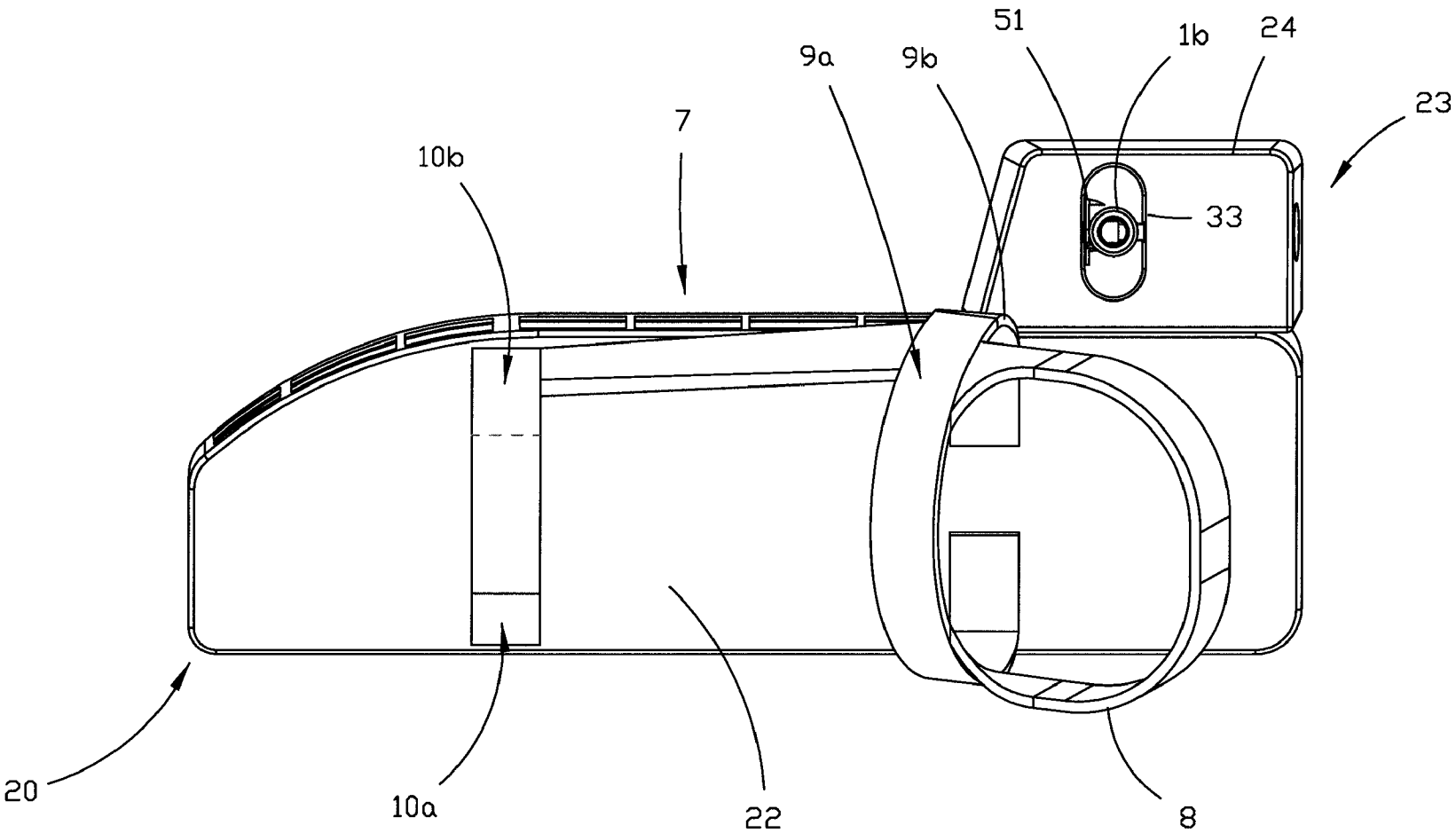
FIG. 1 depicts a top view of a portion of an exemplary golfer training aid.

The following description and drawings illustrate embodiments of the invention sufficiently to enable those skilled in the art to practice it. It is to be understood that the invention is not limited in its application to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, and as described in subsequent paragraphs, the specific mechanical configurations illustrated in the drawings are intended to exemplify embodiments of the invention and that other alternative mechanical configurations are possible.

The exemplary embodiments described herein provide a golf training aid which teaches proper interaction between the lower body and the upper body while also placing other body angles in better position and limiting lateral sway or motion of a golfer during a swing. Referring now in detail to the drawings, wherein like numerals indicate like elements throughout the several views, there is shown in FIGS. 1 through 6 various aspects of the golf training aid.

Referring initially to FIG. 1, a golf training aid 20 is depicted in top view. The training aid 20 comprises a body 22 for receiving a user's foot and which is generally wedge-shaped having a higher end near the outer side of a user's foot and a lower end along the inside of the user's foot. The wedge shape of the body 22 forces the user's weight to be supported along the inside of the user's foot which causes turning of the body against the user's inner thigh muscle of the trailing leg. The body 22 further comprises at least one forward strap 10*a*, 10*b* which is positioned forwardly of the instep and another at least one shoe strap 9*a*,9*b* which is secured to the body of the device and extends outwardly over user's shoe. A third strap 8 extends from the at least one strap 9*a*,9*b* and behind the shoe and holds the two straps 9*a*,9*b* together providing added stability and preventing the user's shoe from sliding. The straps 8, 9*a*, 9*b*, 10*a*, 10*b* may be embedded in the body 22 during the formation of the body 22 by conventional molding techniques or alternatively may be fastened to the body 22 by fasteners embedded in the body 22 during molding. The straps 9, 10 extend from either side of the body and can be wrapped upwardly over the top of the shoe and tightened while strap 8 wraps around the rear of the shoe. The strap portions designated 9*a* and 10*a* are preferably formed with hook and loop fasteners, generally known as (VELCRO) on a top, exposed surface, and the opposite strap ends designated 9*b* and 10*b* have hook and loop fasteners facing the fasteners of straps 9*a* and 10*a*. The strap portions 9*a* and 10*a* are pulled tight over the top of the shoe thereby overlapping different areas of the shoe to provide adjustability for users of different foot sizes. A connecting strap 7 extends from the forward strap 10 to rear strap 9 providing some level of connectivity between the two straps 8, 9, 10.

The training aid 20 further comprises a hip movement guide rod system 23. The guide rod system 23 is attached to the body 22 device by means of two plates and a screw 50, although various connection mechanisms may be utilized. The body 22 receives a user's foot or shoe and disposes the user's weight along the inside of the user's foot while the guide rod system 23 provides feedback to the user with regard to lateral movement of the hips during the golf swing. Specifically, the adjustable guide rod system 23 provides feedback to the user by touching the user's hip or leg when the user sways too much during, for example, a stack-and-tilt golf swing.

Figure 2:
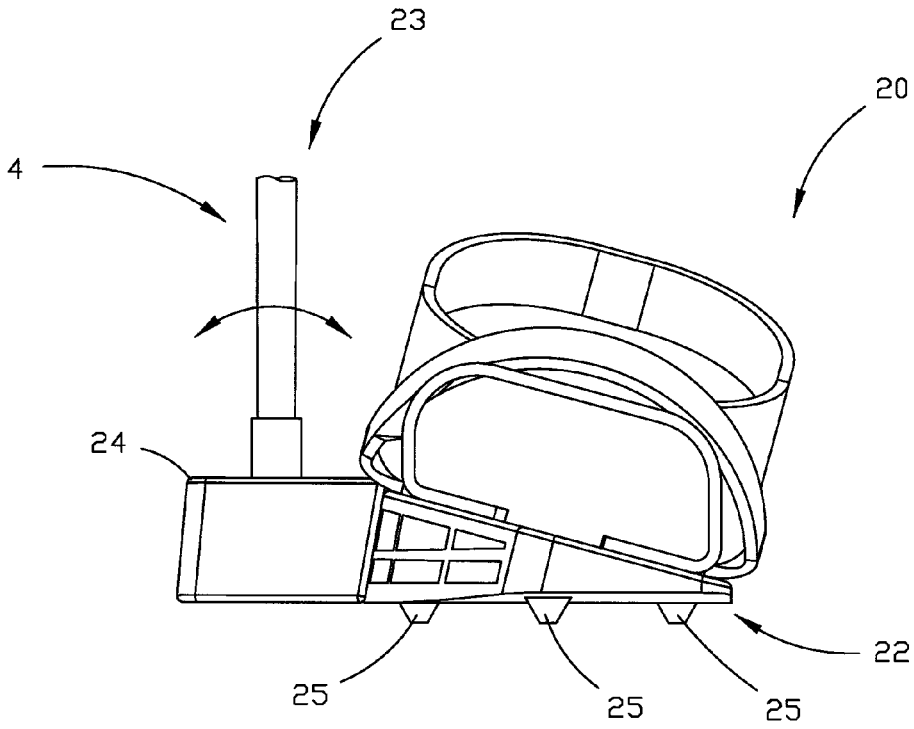
FIG. 2 depicts a front view of the training aid of FIG. 1.

Referring now to FIG. 2, a front view of the golf training aid 20 is depicted. The body 22 receives a user's right foot, which is rear foot for a right handed player. The body 22 is wedge shaped having a higher side along the outer side of the foot and a low side along the inner side of the foot. Upon strapping a foot or shoe to the body 22, the user's weight is forced along the inner side of the foot and provides muscle memory to a user on how the weight positioning should feel during a golf swing.

The guide rod system 23 is shown with a rod assembly 4 inserted. The system 23 comprises a rod assembly 4 is connected to the base portion 24. The rod assembly 4 is pivotally connected to the base portion 24 to define the guide rod system 23. The guide rod assembly 4 is pivotable through a preselected arc in order to move toward and away from the user's hip. The rod assembly 4 may be positioned at multiple locations prior to tightening at the selected position. The rod assembly 4 is movable toward and away from the user's hip about an axis extending into the base portion 24.

Figure 3:
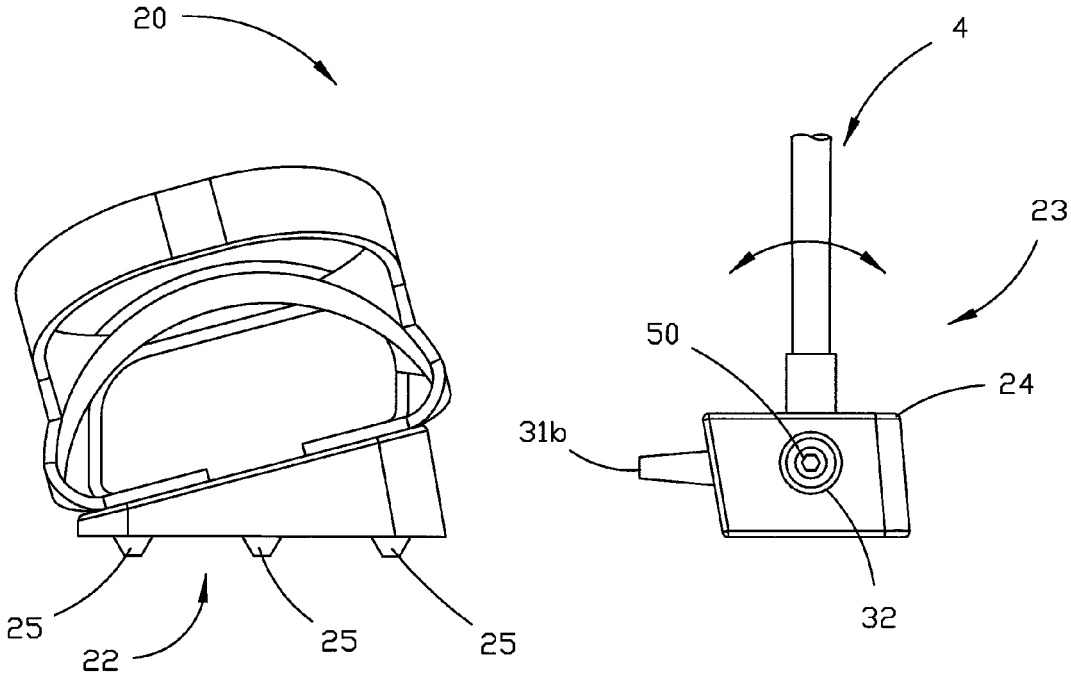
FIG. 3 depicts a partially exploded rear view of the training aid of FIG. 1.

Referring now to FIG. 3, a rear view of the training aid 20 is depicted. The guide rod system 23 is depicted removed from the body 22. The body 22 comprises an opening for receiving an insert 31*b* extending from the base portion 24 of the guide rod system 23. An opening in body 22 is large enough to receive and hold the 31*b* insert. During manufacture a fixative such as glue or cement may be utilized to retain the base portion 24 within the body 22. Alternatively, the insert 31*b* may extend from the body 22 and may be received by an opening in the base portion. As a further alternative, the parts may be fastened together mechanically or the body 22 and the base portion 24 may be integrally formed as a single molded element.

Depending from a lower surface of the body are a plurality of cleats 25. The cleats 25 may be integrally molded into the body 22 or may be removably connected. For example, the cleats 25 may be embodied by hard spikes or soft spikes which are both twistably removable for installation.

The base portion 24 further comprises a fastener aperture or opening 32 through which a fastener is positioned for pivotal movement of the guide rod assembly 4. The base portion 24 also comprises a pivot aperture 33 located in an upper surface which allows for the arcuate motion of the guide rod assembly 4. The pivot aperture 33 is oval in shape to allow for movement of the assembly 4 through an arcuate motion. The apertures 32,33 (FIG. 1) open into a cavity within the base portion 24 and the cavity is partially shown from above in FIG. 1. A fastener 50 extends through the aperture 32 and into the cavity within the base portion 24 to provide the pivot axis for the assembly 4.

Figure 4:
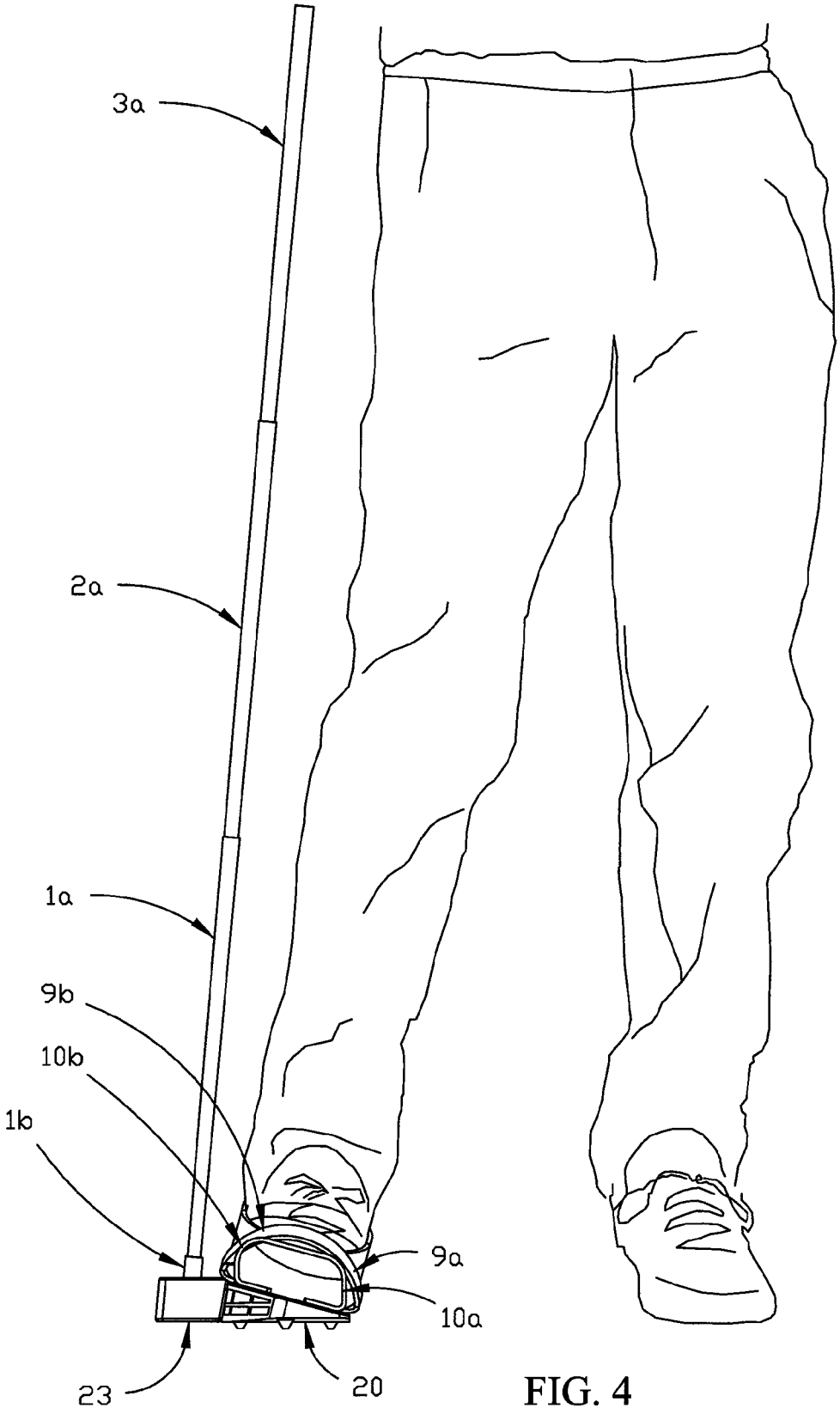
FIG. 4 depicts a front view of the training aid with a user's foot in position for use.

Referring to FIG. 4, a front view of the training aid 20 is depicted with a user shown in broken line utilizing the training aid 20. The user's right foot is positioned on the body 22 and attached thereto by the straps 8, 9, 10. The straps 8, 9, 10 provide stability and prevent the shoe from sliding. The guide rod assembly 4 is shown comprising a plurality of components. Within the opening 23 of base portion 24 is a collar 1*b*. The collar 1*b* is pivotally mounted on the fastener 50 extending through fastener aperture 32 of the base portion 24. As shown in FIG. 1, the collar 1*b* is movable through the pivot aperture 33, so as to adjust the position of the rod assembly 4 relative to the user's hip.

The collar 1*b* receives the guide rod assembly 4 to provide connection between the guide rod assembly 4 and the base portion 24 and thereby define the guide rod system 23. The guide rod assembly 4 comprises a plurality of rod segments or elements which may be disconnected for easy transport and reassembled at different practice locations. However, the plurality of rod elements may alternatively be a single rod of a longer length than any of the single rod elements shown in the exemplary embodiment. The exemplary guide rod assembly 4 is formed of a three-piece construction. A lowermost rod 1*a* is received by the collar 1*b*. The lowermost rod portion 1*a* is at least partially hollow and sized of a diameter capable of positioning within the collar 1*b*. A middle rod portion 2*a* is at least partially hollow and is positioned within the upper end of the rod 1*a* to connect the lowermost rod portion 1*a* and the middle rod portion 2*a*. An upper rod portion 3*a* is positioned with the upper hollow portion of middle rod portion 2*a*. The three rod portions 1*a*, 2*a* and 3*a* define the rod assembly 4. In the exemplary embodiment, friction may be utilized to maintain connection between the rod portions 1*a*, 2*a*, and 3*a*. In one alternative, the rod assembly 4 may be defined by a telescoping or nested rod system which is collapsible for easy storage and transport. Various means may be utilized to connected the rod portions. For example, fasteners or other connectors may alternatively be utilized. According to another exemplary embodiment, the middle rod portion may have a dowel at a lower end and the upper rod portion 3*a* may also have a dowel at a lower end. Each of the dowels would fit into the upper end of the rods 1*a* and 2*a* to form the rod assembly 4 As a result, the rod assembly 4 extends from the base portion 24 to the hip area of the user and may be adjusted through an arcuate distance at various angles so as to touch or engage a user's hip during the golf swing if the user's hips sway too far during the swing. In the embodiment depicted, the guide rod system 23 is adjusted to a desired angle for the depicted user.

Figure 5:
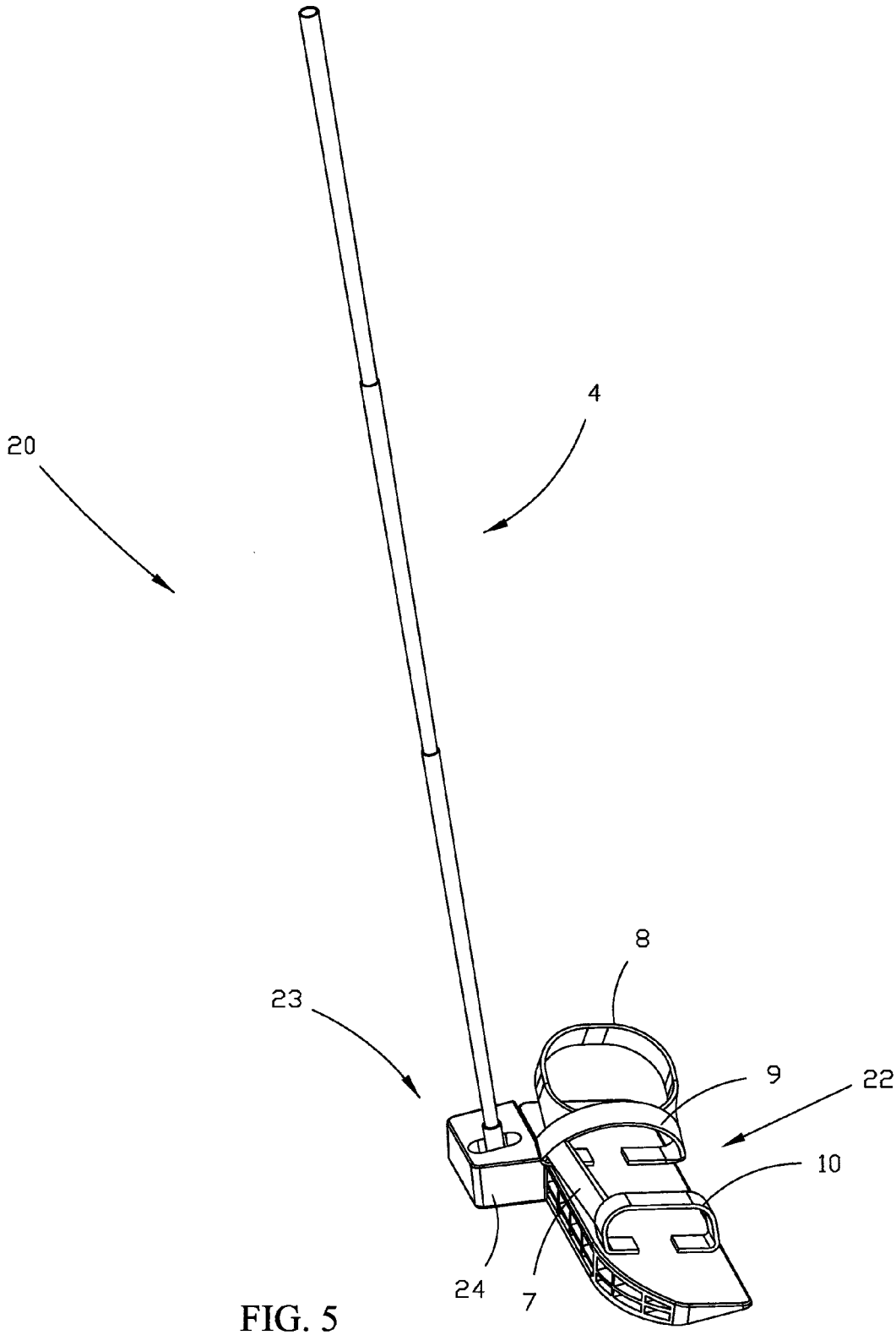
FIG. 5 depicts a perspective view of the golf training aid of FIG. 1.
Figure 6:
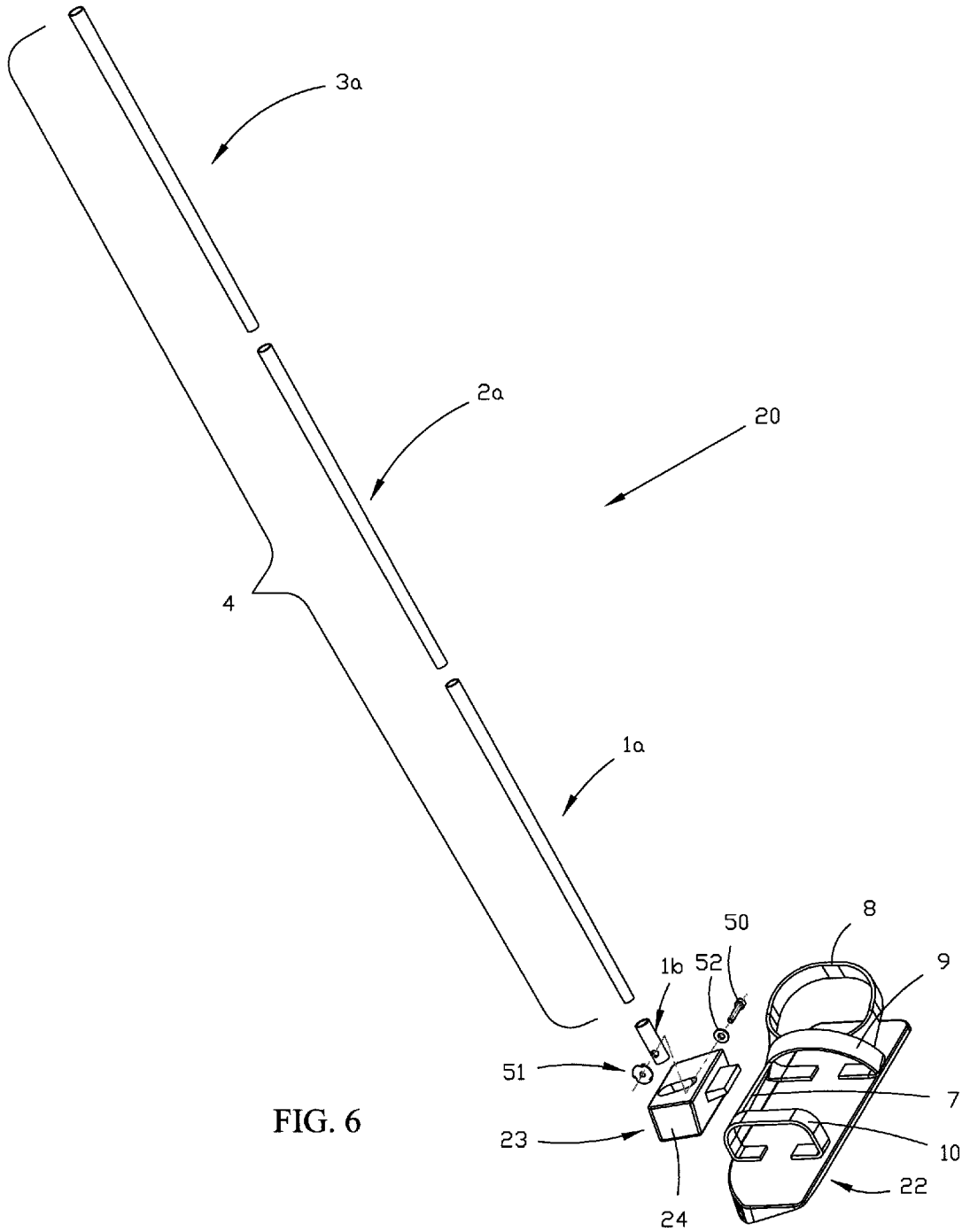
FIG. 6 depicts an exploded perspective view of the golf training aid of FIG. 4.

Referring now to FIGS. 5 and 6, the training aid 20 is shown in perspective view, one of which is an exploded perspective view. The golf training aid 20 comprises a body 22 and a guide rod system 23 connected to the body 22. The body 22 comprises straps 7, 8, 9, 10 providing a means of attaching the device 20 to a user's shoe or foot. The body 22 is shown to have a wedge shaped design forcing a user to place weight along the inside of the foot, which is a desirable characteristic of the stack-and-tilt golf swing as well as limiting lateral sway which is desired by many golf teaching professionals.

The exploded view of FIG. 6 further depicts the fastener 50 extending through the base portion 24 of the guide rod system 23. The fastener 50 extends through a washer 52 into the base portion 24 of the guide rod system 23. The fastener 50 also extends through the collar 1*b* providing pivoting motion of the collar 1*b* and the guide rod assembly 4 connected to the collar 1*b*. A locking nut 51 on the opposite side of the collar 1*b* receives the fastener 50 and engages the collar 1*b* to tighten the collar 1*b* and guide rod assembly 4 at a desired angle for the user. Thus the rod assembly 4 may be tightened at various angles. Various tightening mechanisms may be utilized as will be understood by one skilled in the art.

Figure 7:
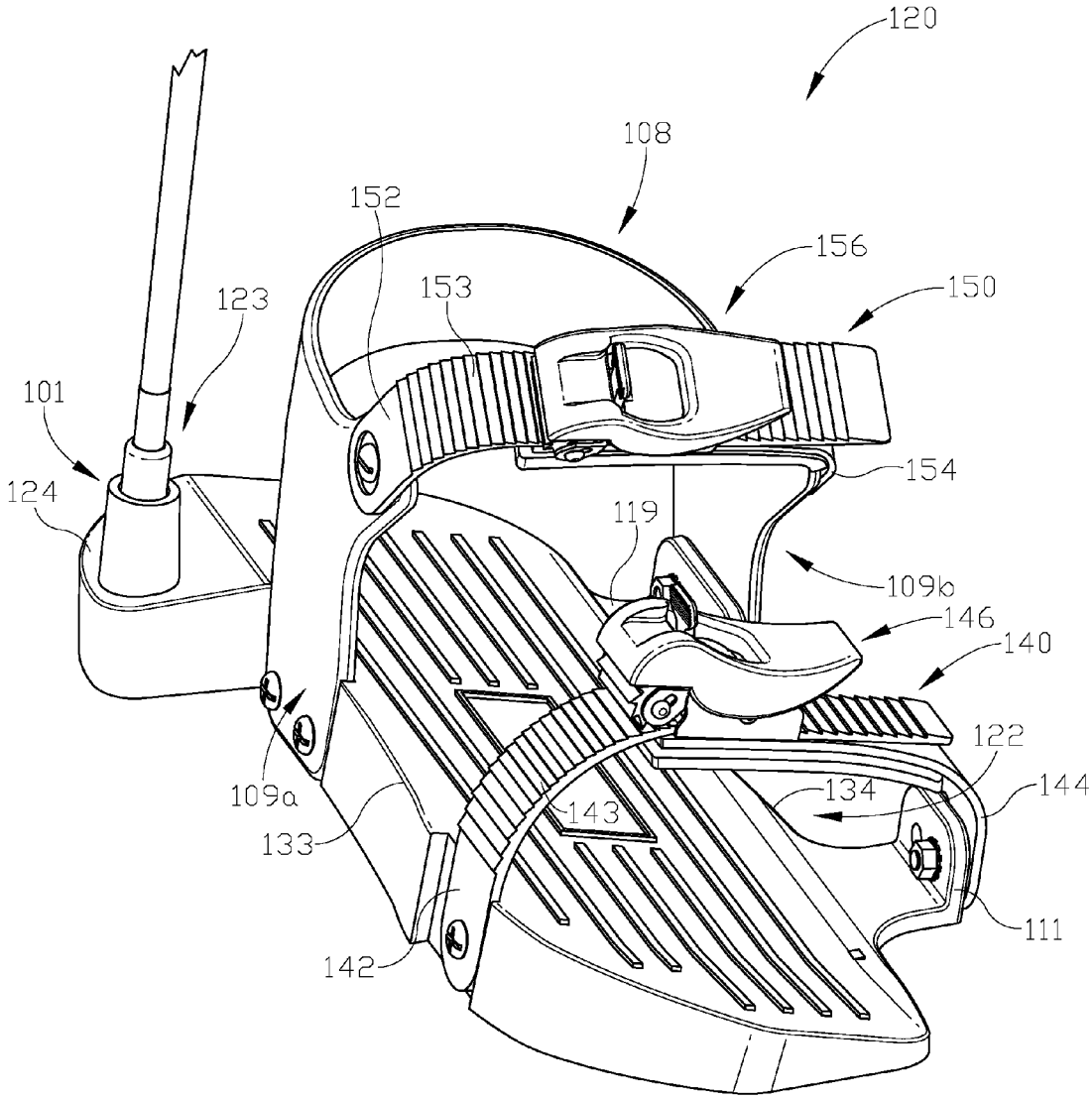
FIG. 7 depicts a perspective view of an alternative golf training aid.

Referring now to FIG. 7, a perspective view of the golf training device is shown. Like the first embodiment, the training aid 120 includes body 122 which is generally wedge shaped, having an outside edge 133 which is higher than a lower inside edge 134. As previously described, this structure directs the user's weight toward the inside edge of the foot inhibiting lateral movement of the user's head and spine. Additionally, the wedge shape also promotes loading of the user's inner thigh muscle which is recommended for a more powerful golf swing. Across this upper surface of the body 122, a plurality of molded ribs are utilized to increase surface friction and help maintain the golf aid 120 in traction with the user's foot or shoe. At a forward portion of the body 122 is a forward strap base 111 which extends from the lower inside edge 134 and provides a position to connect a forward foot or shoe strap assembly 140. Opposite the strap base 111, on the outside wall of body 122, is a notch for receiving an opposite end of the strap assembly 140. A notch is utilized in the exemplary embodiment, however such embodiment should not be considered limiting as alternative structure may be utilized to connect the strap to the body 122.

The forward strap assembly 140 includes a first strap 142 connected in the exemplary embodiment to the outside 133 of the body 122. The first strap 142 further comprises a plurality of teeth 143 which are integrally molded into the strap. However, such design should not be considered limiting as various embodiments are within the ambit of one skilled in the art to render the strap assembly 140 adjustable. The assembly 140 also comprises a second strap 144 which is connected to the body at the inner side 134 at forward strap base 111. The second strap 144 further comprises a quick connector 146 for tightening and loosening the straps 142,144 as well as disconnecting the two straps 142,144 completely. The first strap 142 is positioned through the adjustable quick connector 146 and ratcheted to tighten the straps 142, 144 around a user's trailing foot.

Toward the rear portion of the body 122 is a rear strap base 119 extending from the lower inside edge 134. The rear strap base 119 is utilized to connect a rearward ankle strap assembly 108 to the body 122. According to the instant exemplary embodiment, the ankle strap assembly 108 includes an outside stirrup 109*a* connected to the body 122 and an inside stirrup 109*b* connected to the rear strap base 119. The two stirrups 109*a* and 109*b* extend rearwardly and join to capture a user's ankle or foot. The rear strap assembly 150 wraps around the front of the users ankle so that the ankle is captured between the strap assembly 150 and the rear portion of the stirrups 109*a*, 109*b*. The stirrups 109*a* and 109*b* each have tabs to which the strap assembly 150 connects. The first strap assembly 150 includes a first strap 152 extending from the tab of the outside stirrup 109*b*. The second strap 154 extends from the tab of the inside stirrup 109*b* and is adjustably connected to the first strap 152 by an adjustable quick connect 146. The quick connect 146 is of a ratcheting type however alternate devices may be utilized although this embodiment is merely exemplary. Accordingly one of the straps 152 has a plurality of teeth 153 which engage the adjustable quick connect 146. Additionally, although the rear portion of the ankle strap assembly 108 is shown as unitary with the rear straps 109*a*,109*b*, according to an alternative embodiment the parts may be joined by fasteners to allow pivoting action of the strap 108*b* about a generally horizontal axis. The rear base 119 is connected to the rear strap inside portion by fasteners, such as rivets or screws. Similarly, the rear strap outside stirrup 109*a* is connected to the body 122 by fasteners such as rivets or screws making for an easy connection. These elements, however, may be integrally molded with the body 122 depending on the material utilized for the body 122. The rear ankle strap assembly 108 may be formed integrally of a rigid material or may be a softer, more flexible polymeric or rubber material or both. In the instant embodiment, the strap assembly 150 is formed of a more flexible rubberized material while the stirrups 109*a*, 109*b* are formed of a more rigid material than straps 142, 144 and 152, 154 in order to provide additional stability and support to a user.

At the rear outside portion of the body 122 is a guide rod system 123. According to the instant embodiment, the guide rod system 123 is integrally molded with the body 122. However, this is merely exemplary as the guide rod system 123 may also be detachable from the body 122. The guide rod system 122 includes a base 124 and a collar 101 extending from an upper portion of the base structure 124. The collar 101 receives a rod 102. The rod 102 may be a single rod or may be formed of two or more rod components which are fastened or connected together in some fashion. The guide rod collar 101 is integrally formed with and rigidly connected to the base 124, however according to alternative embodiments, the collar 101 may be pivotally connected to adjust the angle of the rod 102.

Figure 8:
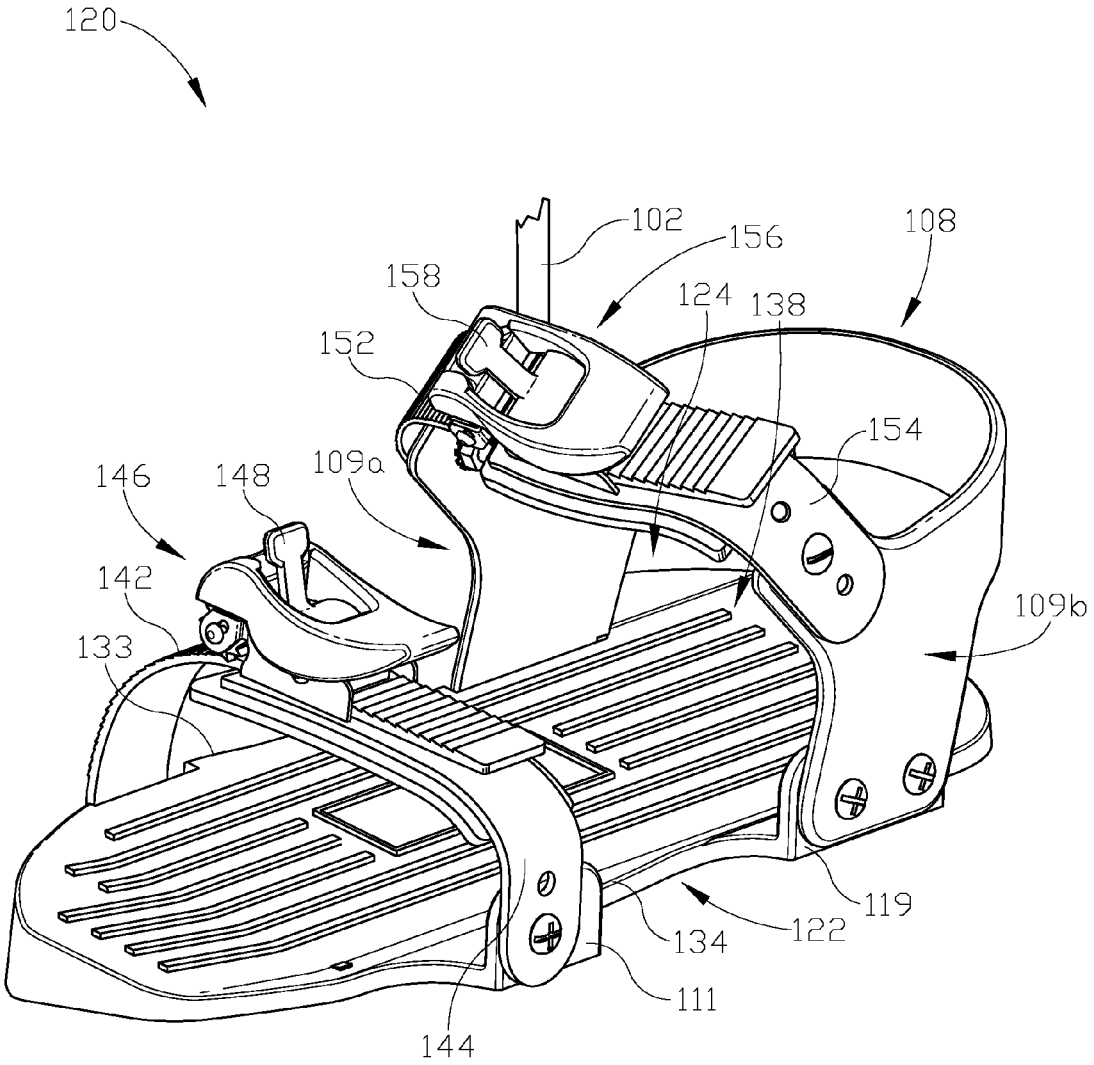
FIG. 8 depicts an alternate perspective view of the golf training aid of FIG. 7.

Referring to FIG. 8, a side perspective view of the golf aid 120 is depicted. The body 122 includes the gripping ribs 138 along the upper surface of the body 122. Extending from the inner edge 134 are the forward and rearward strap bases 111,119. Extending upwardly from behind the outside strap 109*a* is the rod 102 which extends from the base 124.

Also depicted in FIG. 8 is one movable component of the adjustable quick connects 146, 156 for the strap assemblies 140, 150. The quick connect 146 includes a lever 148 for adjustably tightening or loosening the first strap 142 relative to the second strap 144. Similarly, the rear adjustable quick connect 156 strap includes a lever 158 for loosening or tightening the strap 152 relative to the strap 154. The levers 148, 158 may be spring loaded and normally biased downward to engage the teeth 143, 153 of the straps 142, 152. In the upward position depicted in FIG. 8, the teeth 143,153 are disengaged allowing movement of the straps 142, 152 relative to the opposed straps 144, 154, respectively.

Figure 9:
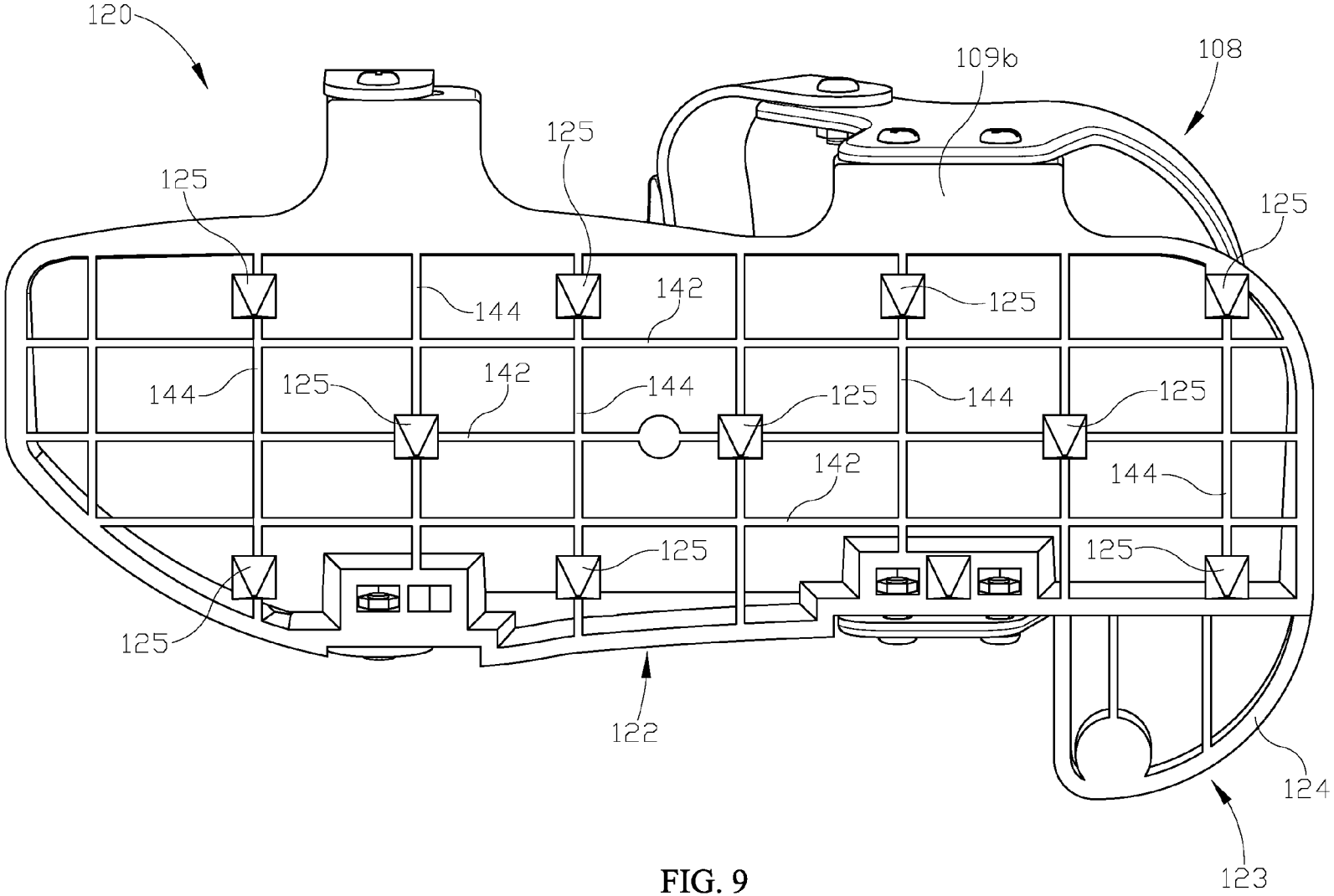
FIG. 9 depicts a bottom view of the golf aid of FIG. 7.

Referring to FIG. 9, a bottom view of the golf aid 120 is depicted. The body 122 has a molded undersurface comprising a plurality of cleats 125 for traction when the aid 120 is utilized. The cleats 125 are integrally formed with the body in the current embodiment. However, the body 122 may also include apertures for replaceable spikes, hard or soft, which may be used with the present invention. The bottom of the body 122 is also defined by the plurality of strengthening ribs. The ribs are generally defined by a plurality of latitudinal ribs 142 and longitudinal ribs 144. These ribs 142, 144 allow for removal of material therebetween which reduces the weight of the aid 120 making it easy to carry to a driving range or other practice facility or area.

Figure 10:
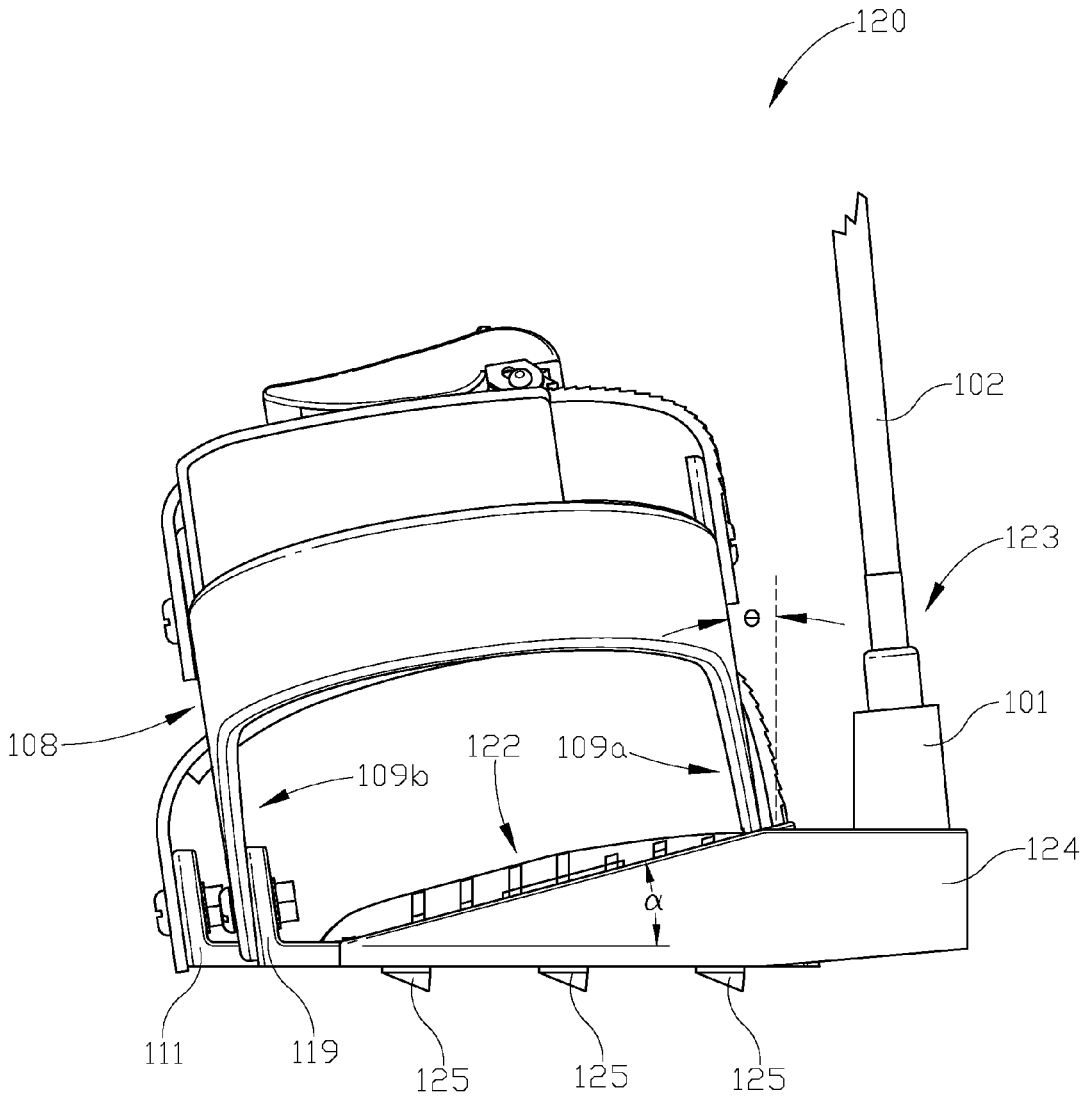
FIG. 10 depicts a rear view of the golf aid of FIG. 7.

Referring now to FIG. 10, a rear view of the golf aid 120 is depicted. The rear ankle strap assembly 108 is shown connected to the body 122. In this view, the wedge shape clearly provides for an upper surface of the body 122 which is slanted toward the inside of the user's foot or the golf aid 122 while maintaining a lower body surface which is generally flat and includes the plurality of cleats 125. Due to the angled upper surface of the body 122, the rear straps 109 are generally extending upward at an angle from the vertical. The angle is depicted as angle $\theta$ and is reference from a vertical broken line. However the angle of the stirrups 109*a*, 109*b* are not a necessity as the angle may be zero (0) or the angle may vary from depending on the angle of notch where stirrup 109*a* connects to the body 122 as well as the angle of the rear base 119. The rear strap assembly 108 may alternatively be adjustable to change the angle of the straps 109*a*, 109*b*.

With FIG. 10 shown from behind, the angle $\alpha$ of the wedge shaped body 122 is clearly depicted. The angle $\alpha$ may be in the range of from about five (5) degrees to about twenty-five (25) degrees. The wedge shaped bodies 122 may be formed of different angles $\alpha$ for various users, depending on the body type of the user. Thus a user could have a more appropriately fitting aid 120. In an alternative embodiment, the wedge shaped body 120 may be formed of a separate upper portion and a lower portion wherein one of the upper and lower portion could be exchangeable. Additionally, one of the exchangeable upper and lower portions could be formed with different angles so that the upper angle $\alpha$ may also be varied to fit different users. In yet a further alternative, where the body 122 is formed separately of the base 124 and later connected together, the multiple bodies 122 may be formed with multiple angles allowing a user to select a wedge shape having an angle $\alpha$ which best suits the user. In other words, these alternate embodiments would allow for varying of the angle $\alpha$ of the wedge shaped body 122.

Figure 11:
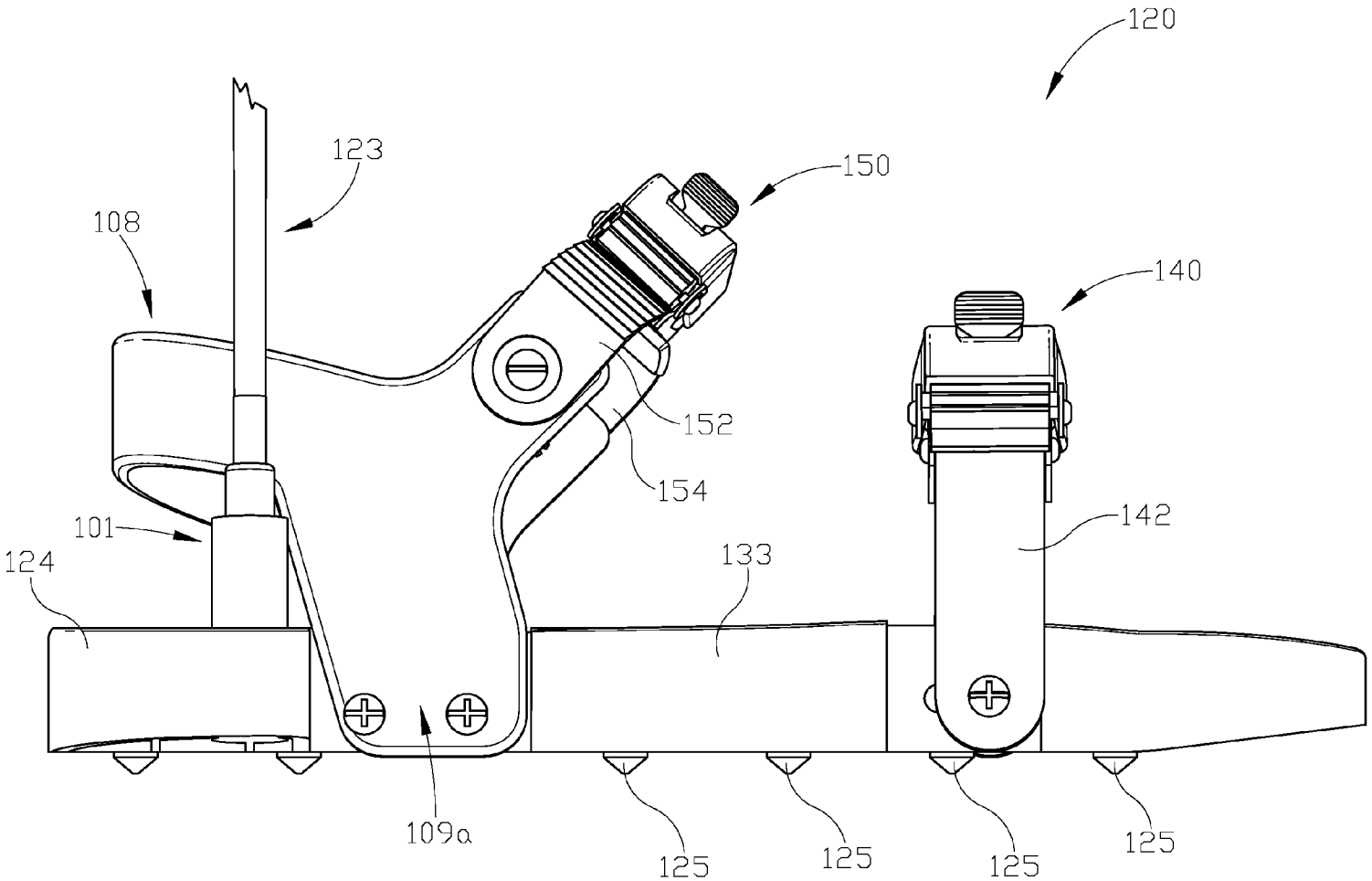
FIG. 11 depicts a side view of the golf aid of FIG. 7.

Referring now to FIG. 11, a side view of the golf aid 120 is depicted with the guide rod system connected to body 122 and the strap assemblies 140 and 150. Depending from the lower surface of the body 122 is the plurality of cleats 125. The view depicted in FIG. 11 is of the outside edge 133.

It is apparent that variations may be made to the golf training aid in regards to specific design elements thereof. Such variations however are deemed to fall within the teachings of the present invention as generally modifications may be made to placement of the particular structure described herein or equivalents thereto while falling within the general teachings hereof.

I claim:

1. A golf training device, comprising:

a wearable wedge shaped body for receiving a user's trailing foot and restricting lateral movement of a user's hip;

at least one foot strap assembly connected to said wedge shaped body;

a guide rod system connected to said wedge shaped body comprising:

a base portion connected to said wedge shaped body;

a collar disposed in said base portion; and, a guide rod engaging said collar and extending upwardly from said collar toward said user's hip;

said guide rod system indicating a swing error when said user's hip contacts said guide rod.

2. The golf training device of claim 1, said wedge forcing weight to the inside of said user's trailing foot.

3. The golf training device of claim 1 further comprising a forward foot strap assembly connected to said body.

4. The golf training device of claim 3 said forward strap assembly being adjustable to tighten or loosen utilizing an adjustable quick disconnect.

5. The golf training device of claim 3, said forward strap assembly having a first strap and a second strap which are connected by an adjustable quick disconnect.

6. The golf training device of claim 3 further comprising at least one rearward strap assembly connected to said body.

7. The golf training device of claim 6, said at least one rearward ankle strap having an outside portion, an inside portion and a strap assembly.

8. The golf training device of claim 7, said strap assembly comprising a first strap having a plurality of teeth and a second strap having a quick disconnect.

9. A wearable golf training device for a golf swing comprising:

a body having a wedge shape with a high side and a low side, and an inside of said body being said low side and an outside of said body being said high side, said body receiving a user's trailing foot and restricting lateral movement of the user's hip;

a forward strap assembly connected to said body and a rearward ankle strap assembly including an ankle portion; and, a guide rod system comprising:

a base portion connected to said body;

a collar disposed in said base portion;

a guide rod being received by said pivotable collar extending upwardly from said collar toward or away from a user's hip;

said guide rod system indicating excessive lateral movement during a golf swing when said user's hip contacts said guide rod.

10. The golf training device of claim 9 further comprising a first strap assembly near a forward portion of said body, and a second ankle strap assembly near a rear portion of said body.

11. The golf training device of claim 10, said first strap assembly having a first strap and a second strap, one of said first and second straps having teeth, the other of said first and second straps having an adjustment mechanism for engaging said teeth.

12. The golf training device of claim 10 said ankle strap assembly having an inside stirrup portion along said inside of said body, an outside stirrup portion along said outside of said body and an ankle portion connecting said outside stirrup portion and said inside stirrup portion.

13. The golf training aid of claim 12 further comprising a first strap and a second strap, one of said first strap and said second strap having teeth and the other of said first and second strap having an adjustable quick connect mechanism, said first strap connected to said outside stirrup and said second strap connected to said inside stirrup.

14. The golf training device of claim 9, said body being a molded device.

15. The golf training device of claim 9, said body and said base portion being integrally molded.

16. The golf training device of claim 9 wherein one of said body and said base portion has an insert, and the other of said base portion and said body has a cavity.

17. The golf training device of claim 9 further comprising cleats depending from said body.

18. The golf training device of claim 17, said cleats molded to said body.

19. The golf training device of claim 17 said cleats being removable from said body.

20. A golf training aid, comprising:

a body having a wedge shape wherein an outside of said body is higher than said inside of said body;

said wedge shaped body inhibiting lateral movement of a user's body and promoting loading of an inside thigh muscle of said user;

a guide rod system having a base which is one of integrally formed with or removably connected to said body;

said guide rod system having a collar extending from said body, said collar engaging a guide rod, said guide rod extending upwardly from said base;

a first strap assembly at a forward portion of said body and a second ankle strap assembly at a rear portion of said body;

each of said first strap and said second strap being adjustable for tightening and loosening said training aid on a user's foot.

* * * * *